US007130565B2

(12) United States Patent
Nakamura et al.

(10) Patent No.: US 7,130,565 B2
(45) Date of Patent: Oct. 31, 2006

(54) CHARGING APPARATUS AND IMAGE FORMING APPARATUS

(75) Inventors: Ryo Nakamura, Mishima (JP); Hiroyuki Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 10/859,344

(22) Filed: Jun. 3, 2004

(65) Prior Publication Data

US 2005/0008396 A1 Jan. 13, 2005

(30) Foreign Application Priority Data

Jun. 3, 2003 (JP) ..... 2003-158101
Jun. 3, 2003 (JP) ..... 2003-158102

(51) Int. Cl.
*G03G 15/02* (2006.01)

(52) U.S. Cl. ..... 399/175

(58) Field of Classification Search ..... 399/168, 399/174, 175, 176; 361/225
See application file for complete search history.

(56) References Cited

U.S. PATENT DOCUMENTS 5,367,365 A * 11/1994 Haneda et al. ..... 399/174
5,576,812 A 11/1996 Hibino et al.
6,292,640 B1 9/2001 Suzuki ..... 399/175
6,330,411 B1 12/2001 Suzuki ..... 399/120
6,792,232 B1 * 9/2004 Suzuki et al. ..... 399/175

FOREIGN PATENT DOCUMENTS

JP 06-161211 * 6/1994
JP 9-325564 12/1997

* cited by examiner

*Primary Examiner*—Sandra L. Brase
(74) *Attorney, Agent, or Firm*—Fitzpatrick, Cella, Harper & Scinto

(57) ABSTRACT

A charging apparatus includes first and second magnetic particle carrying members. The second member is upstream of the first member in a particle feeding direction at a nip between the first member and a member to be charged. The particles are commonly used by the first and second members, which move in the same peripheral direction relative to the member to be charged such that the peripheral movement directions of the first and second members are opposite to a peripheral movement direction of the member to be charged at a portion where they are opposed to the member to be charged. The amount of the particles on the second member at a nip between the second member and the member to be charged is larger than the amount of particles on the first member at a nip between the first member and the member to be charged.

16 Claims, 8 Drawing Sheets

CHARGING APPARATUS AND IMAGE FORMING APPARATUS

FIELD OF THE INVENTION AND RELATED ART

The present invention relates to a charging apparatus employing a magnetic brush, and an image forming apparatus.

There have been designed various electrophotographic or electrostatic image forming apparatuses. Here, however, the general structure and operation of a typical image forming apparatus will be briefly described with reference to an image forming apparatus shown in FIG. 2.

As a copy start signal is inputted into the image forming apparatus shown in FIG. 2, the peripheral surface of a photosensitive drum 1 is charged to a predetermined potential level by a corona type charging device 3. Meanwhile, an original G placed on an original placement platen 10 is scanned by a beam of light projected from a unit 9 comprising a lamp for illuminating the original, a short focal point lens array, and a CCD sensor. As the unit 9 scans the original G, the light from the unit 9 is reflected by the surface of the original G, and the reflected light is focused onto the CCD sensor by the short focal point lens array. The CCD sensor comprises a light receiving portion, a transferring portion, and an outputting portion. As the reflected light is received by the light receiving portion of the CCD sensor, the signals borne by the reflected light are converted in the light receiving portion, into electric charges, which are sent to the transferring portion, from which they are sequentially sent to the outputting portion in synchronization with clock pulses. In the signal outputting portion, the electric charges are converted into voltage signals, are amplified, and are reduced in impedance. Then, the thus obtained voltage signals, which are analog signals, are outputted from the outputting portion of the CCD sensor. Then, the voltage signals (analog signals) are converted into digital signals by being subjected to one of the known image processing sequences. The thus obtained digital signals (image formation signals) are sent to a printing portion of the image forming apparatus. In the printing portion, an exposing means 2, which employs LEDs, is turned on or off in response to the digital image formation signals. As a result, an electrostatic latent image reflecting the original is formed on the peripheral surface of the photosensitive drum 1.

Next, the electrostatic latent image is developed by a developing device 4, which contains particulate toner. As a result, a toner image is formed on the peripheral surface of the photosensitive drum 1. Then, the toner image on the photosensitive drum 1 is electrostatically transferred onto transfer medium by a transferring apparatus 7. Thereafter, the transfer medium is electrostatically separated from the photosensitive drum 1, and is conveyed to a fixing device 6, in which the image (unfixed) on the transfer medium is thermally fixed to the transfer medium. Then, the transfer medium is outputted from the image forming apparatus.

Meanwhile, the portion of the peripheral surface of the photosensitive drum 1, from which the toner image has just been transferred away, is cleared by a cleaner 5 of adhesive contaminants such as the toner remaining thereon, and is exposed, as necessary, to a pre-exposing means 8, which is for erasing the photonic memory left by the preceding image formation exposure, in order to be used again for image formation.

As for the photosensitive drum used in the above described image formation process, in other words, the photosensitive drum employed by an electrophotographic image forming apparatus, an organic photosensitive member, amorphous silicon based photosensitive member (which hereinafter will be referred to as a-Si photosensitive member), etc., in particular, an a-Si photosensitive member, are popularly used. An a-Si photosensitive member is high in surface hardness, and is highly sensitive to an semiconductor laser beam, and the like. In addition, its deterioration resulting from repetitive usage is negligible. Therefore, an a-Si photosensitive member is widely used in the field of such an electrophotographic image forming apparatus, e.g., the field of high speed copying machines, laser beam printers (LBP), etc.

However, an a-Si photosensitive member is manufactured by forming a film of a-Si on the peripheral surface of an aluminum cylinder by depositing a-Si plasma created by the superheating of a-Si with high frequency waves or microwaves. Thus, unless the plasma is uniform, the a-Si film becomes nonuniform in thickness and composition in terms of both the lengthwise and circumferential directions of the aluminum cylinder, as it is formed.

Further, compared to an organic photosensitive drum, an a-Si photosensitive drum is substantially greater in the rate at which its potential attenuates after it is charged. This difference in potential attenuation between an organic photosensitive drum and an a-Si photosensitive drum remains substantial even when the two drums different in type are kept unexposed. In addition, the potential attenuation is exacerbated by the photonic memory effected by the exposure process carried out during the preceding rotation of the photosensitive drum. Therefore, the amount of the potential attenuation which occurs between when the photosensitive drum is charged and when the photosensitive drum is developed is very large, being in the range of 100–200 V. Also during this period, the charge portion of the peripheral surface of the photosensitive drum becomes nonuniform in potential level in terms of the circumferential direction thereof, in the range of 10–20 V, because of the aforementioned nonuniformity in film thickness.

The occurrence of the above described nonuniformity in potential level to an a-Si photosensitive drum results in the formation of an image, the nonuniformity of which in density is conspicuous, because an a-Si photosensitive drum is larger in electrostatic capacity, and lower in contract, being therefore more likely to be nonuniformly charged, or become nonuniform in potential level after being charged, than an organic photosensitive drum.

As for the method for solving the above described problem, it is effective to charge the photosensitive drum 1 two or more times, for the following reason. That is, the photonic memory from the preceding image forming rotations of the photosensitive drum 1 can be substantially reduced by the first charging process. Therefore, after the photosensitive drum 1 is subjected to the second charging process, the non-exposure potential attenuation will be substantially smaller. Therefore, the image defects attributable to the photonic memory (ghost) and/or nonuniformity in potential level will be far less likely to occur.

As for the methods for charging an a-Si photosensitive drum, there are a corona-based charging method which utilizes corona discharge, a roller-based charging method using a roller-based charging device that employs an electrically conductive roller to charge an object by utilizing the direct discharge between the roller and object, a charge-injection-based charging method which charges an object by directly injecting electric charge into the peripheral surface of a photosensitive member, with the use of such a charge injecting means as a magnetic brush formed of magnetic particles capable of contacting the surface of the object to be charged, across a larger area thereof than a roller based charging device, and the like methods. Among the above-listed charging methods, a corona-based charging method and a roller-based charging method utilize electric discharge to charge an object. Therefore, when these two charging methods are employed, by-products of electric discharge tend to adhere to the surface of the object to be charged. Further, the surface of an a-Si photosensitive member is very hard, being therefore not likely to easily wear. Therefore, once the by-products of electric discharge adhere to the surface of an a-Si photosensitive member, they tend to remain thereon. This presence of the by-products of electric discharge on the surface of an a-Si photosensitive member creates the following problem. That is, if an a-Si photosensitive member, the peripheral surface of which is contaminated with the by-products of electric discharge, is used under a high humidity condition, water vapor condenses on the peripheral surface of the a-Si photosensitive member, allowing the electric charge, forming the electrostatic latent image on the a-Si photosensitive member, to transfer across the peripheral surface of the a-Si photosensitive member in the direction of the plane of the peripheral surface of the a-Si photosensitive member, resulting in the formation of an image which appears as if it has been smeared.

In comparison, the above-mentioned injection charging method is such a charging method that directly injects electric charge into a photosensitive drum through the contact area between the peripheral surface of the photosensitive drum and the charging means, instead of primarily relying on electric discharge. Therefore, it is not likely to cause the above-mentioned problem that an image which appears smeared is formed.

A charging method which uses a magnetic brush is one of the injection charging methods. In this method, electrically conductive magnetic particles are magnetically confined in the form of a brush, directly on a magnet, or on the peripheral surface of a sleeve that internally holds a magnet. The surface of an object to be charged is placed in contact with the magnetic brush, which is kept stationary or moved along the peripheral surface of the sleeve, in order to directly charge the peripheral surface of the object.

A magnetic-brush-based charging method is superior in terms of the state of contact between an object to be charged and a charging means, being therefore superior in terms of reliability with which an object can be charged. Therefore, it is preferably used as a charging means.

An injection charging method does not utilize electric discharge, which is utilized by a corona-type charging device to charge an object. Therefore, the potential level of the charge bias necessary for charging an object is the same as the potential level to which the object is desired to be charged. Moreover, it does not generate ozone, being therefore completely ozone free, and also, smaller in power consumption. Thus, it has begun to attract attention in recent years.

As will be evident from above, from the standpoint of the uniformity with which an a-Si photosensitive drum is charged, a charging method employing multiple charging means disposed around the peripheral surface of a photosensitive drum is advantageous. From the standpoint of preventing the formation of an image with the smeared look, and reliability, an injection charging method employing a magnetic brush as a charging means for charging a photosensitive drum is advantageous. For example, Japanese Laid-open Patent Application No. 9-325564 discloses a charging apparatus structured so that magnetic particles are transferred between the adjacent two magnetic brushes among multiple magnetic brushes. Not only does this structural arrangement prevent magnetic particles from stagnating between the adjacent two magnetic brushes, but also, it is effective to make it possible to provide a compact charging apparatus.

However, a charging apparatus such as the one described above structured so that magnetic particles are transferred between the adjacent two magnetic brushes suffers from the problem that if the contact between the magnetic particles and photosensitive drum is unnecessarily intense, the amount by which the peripheral layer of a photosensitive drum is frictionally worn by the magnetic particles becomes excessive.

In particular, when employing multiple magnetic brushes, the friction between a photosensitive drum and magnetic particles must be reduced as much as possible in order to make the photosensitive drum last as long as possible. However, simply reducing the amount of magnetic particles borne by a magnetic particle bearing member in order to reduce the amount of friction between the photosensitive drum and magnetic particles is problematic in that it reduces the charging performance of the magnetic-brush-based charging device in charging performance.

SUMMARY OF THE INVENTION

The present invention was made to solve the above-described problems, and the primary object of the present invention is to reduce the amount by which an object to be charged is frictionally worn by magnetic particles by adjusting the amount of magnetic particles borne on the magnetic particles bearing member, in the nip between the object and magnetic particle bearing member.

Another object of present invention is to reduce the nonuniformity with which an object is worn by the magnetic particles.

Another object of the present invention is to prevent a charging nip from being satiated with magnetic particles.

Another object of the present invention is to realize a charging apparatus which is more durable and reliable than a charging apparatus in accordance with the prior art.

DETAILED DESCRIPTION OF THE PREFERRED EMBODIMENTS (Embodiment 1)

Figure 3:
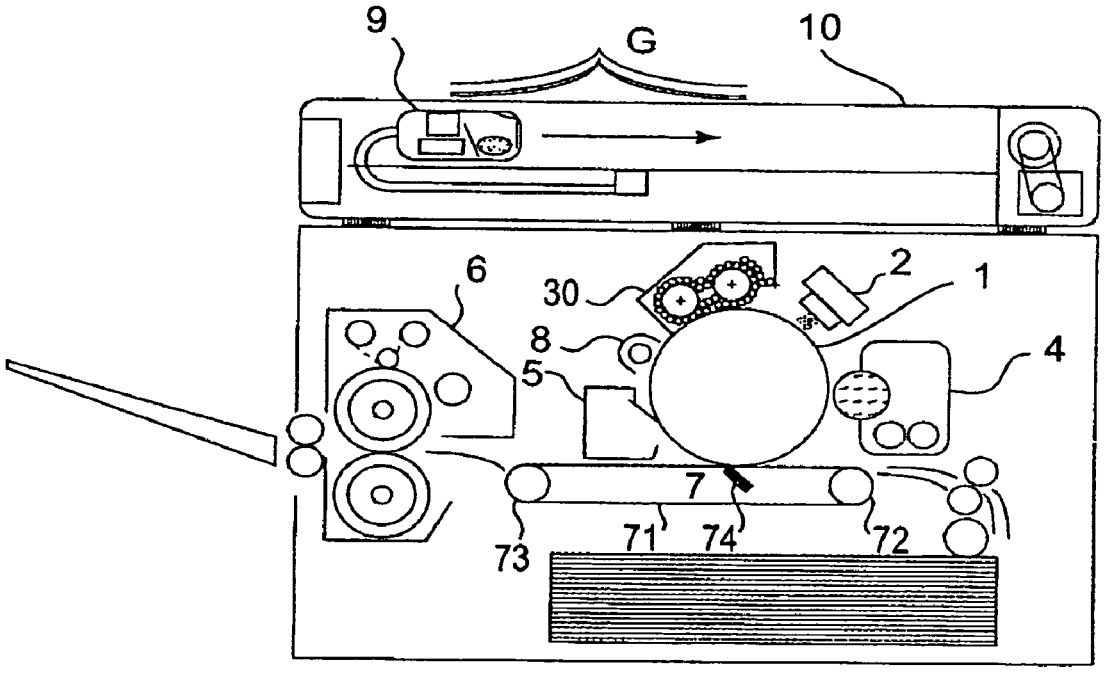
FIG. 3 is a schematic sectional view of the image forming apparatus in the preferred embodiment of the present invention.

The image forming apparatus in this embodiment is schematically shown in FIG. 3.

As a copy start signal is inputted, the peripheral surface of the photosensitive drum 1 as an object to be charged is charged to a predetermined potential level by a magnetic brush based charging apparatus 30. Here, the chargeable layer of the photosensitive drum 1 is formed of amorphous silicon, the inherent polarity of which is positive. The magnetic brush based charging apparatus 30 employs an injection charging method which charges an object by directly injecting electric charge into the surface layer of the photosensitive drum 1 with the use of magnetic particles or the like. Meanwhile, an original G placed on an original placement platen 10 is scanned by a unit 9 comprising a lamp for illuminating the original, a short focal point lens array, and a CCD sensor. As the unit 9 scans the original, the light from the unit 9 is reflected by the surface of the original, and the reflected light is focused onto the CCD sensor by the short focal point lens array. The CCD sensor comprises a light receiving portion, a transferring portion, and an outputting portion. As the reflected light is received by the light receiving portion of the CCD sensor, the signals carried by the reflected light are converted into electric charges, which are sent to the transferring portion, from which they are sequentially sent to the outputting portion in synchronization with clock pulses. In the outputting portion, the electric charges are converted into voltage signals, are amplified, and are reduced in impedance. Then, they are outputted from the outputting portion of the CCD sensor. Then, the voltage signals (analog signals) are converted into digital signals by being subjected to one of the known image processing sequences. The thus obtained digital signals (image formation signals) are sent to a printing portion of the image forming apparatus. In the printing portion, an exposing means 2 as an image writing means, which employs LEDs as light emitting means, is turned on or off in response to the digital image formation signals. As a result, an electrostatic latent image reflecting the original is formed on the peripheral surface of the photosensitive drum 1.

Next, the electrostatic latent image is developed by a developing device 4 as a developing means, which contains particles of toner. As a result, a toner image is formed on the peripheral surface of the photosensitive drum 1. Then, the toner image on the photosensitive drum 1 is electro-statically transferred onto transfer medium by a transferring apparatus 7 as a transferring means. Thereafter, the transfer medium is electrostatically separated from the photosensitive drum 1, and is conveyed to a fixing device 6, in which the image (unfixed) on the transfer medium is thermally fixed to the transfer medium.

The portion of the peripheral surface of the photosensitive drum 1, from which the toner image has just been transferred away, is cleared by a cleaner 5 of adhesive contaminants such as the toner remaining thereon, and is exposed, as necessary, to a pre-exposing means 8, which is for erasing the photonic memory left by the preceding image formation exposure, in order to use the portion again for image formation.

The magnetic brush based charging apparatus in this embodiment comprises: magnetic particle bearing members; and multiple (two in this embodiment) magnets 33 as magnetic field generating members having multiple magnetic poles, and electrically conductive magnetic particles confined in the form of a brush (magnetic brush) on the peripheral surface of the magnetic particle bearing members. The magnetic particle bearing member may be a magnetic itself, or a nonmagnetic sleeve internally holding a magnet. The magnetic brush is placed in contact with the peripheral surface of the photosensitive drum 1. As voltage is applied to the magnetic particle bearing members, while the magnetic brushes are kept stationary, or moved with the peripheral surface of the magnetic particle bearing member, the photosensitive drum 1 is charged.

Among the above-described structural components of the image forming apparatus, that is, photosensitive drum 1, charging means, developing means, cleaning means, etc., two or more of them may be integrated into a process cartridge by integrally placing them in a cartridge removably mountable in the main assembly of an electrostatic latent image such as a copying machine, a laser beam printer, etc. For example, the magnetic brush based charging apparatus 30 in this embodiment, developing means or cleaning means, or both, and photosensitive member, may be integrated into a process cartridge (they may be integrally supported in a cartridge removably mountable in apparatus main assembly), which can be removably mountable in the main assembly of an image forming apparatus, along such a guiding means as a pair of rails with which the main assembly is provided.

Figure 4:
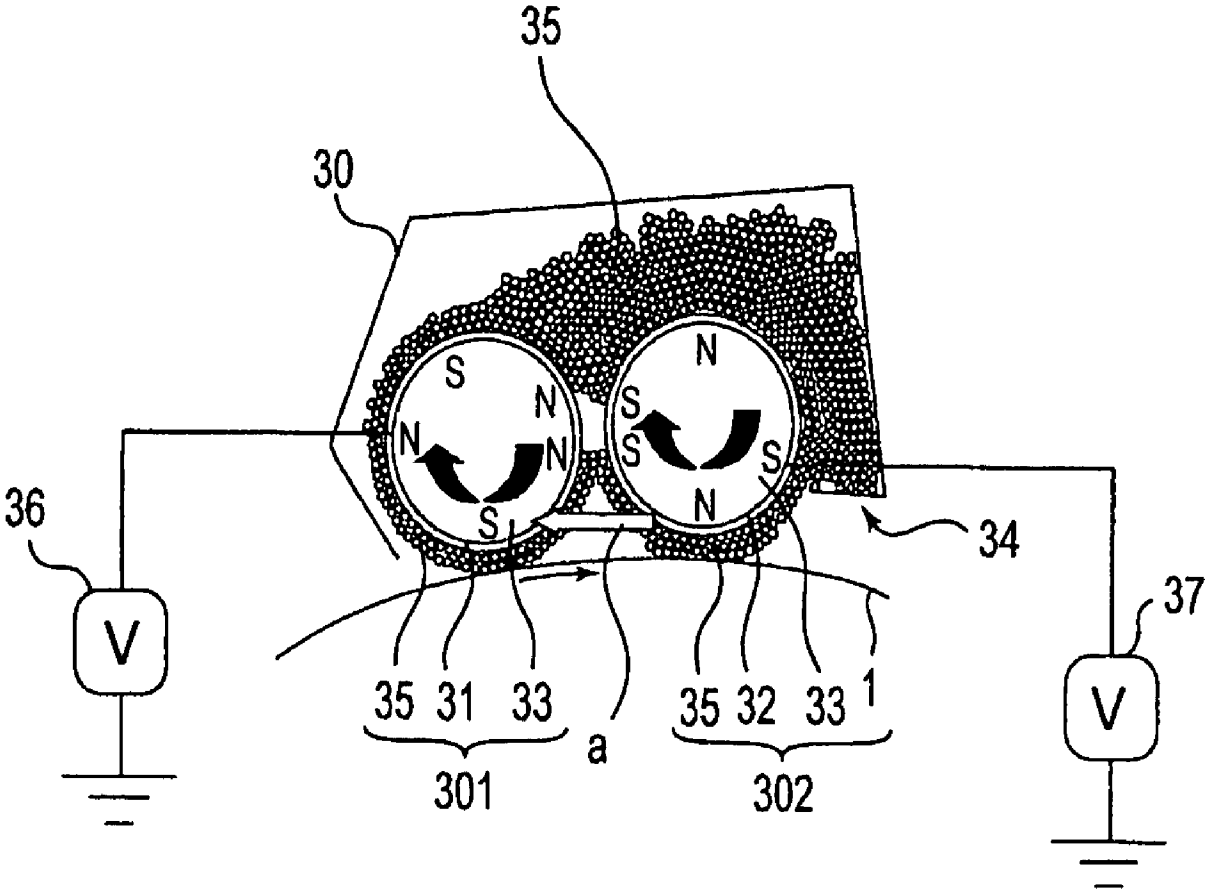
FIG. 4 is a schematic sectional view of the modified version of the charging apparatus in the preferred embodiment of the present invention.

Next, referring to FIG. 4, the charging apparatus in this embodiment will be described. The charging apparatus 30 in this embodiment comprises: a first magnetic brush based charging device 301 as a magnetic brush based charging means; and a second magnetic brush based charging device 302 as a second magnetic brush based charging means. The second magnetic brush based charging device 302 is on the upstream side of the first magnetic brush based charging device 301, in terms of the direction in which the magnetic particles are conveyed in the nip between the first magnetic bush based charging device 301 and photosensitive drum 1. The two magnetic brush based charging devices 301 and 302 each comprise: a magnet 33 as a magnetic field generating member; and a first (second) charge sleeve 31 (32) as a magnetic particle bearing member, rotatably fitted around the magnet 33; and magnetic particles 35 shared by the two magnetic brush based charging devices. Each sleeve is rotated in the clockwise direction. In other words, the two sleeves are the same in the direction in which their peripheral surfaces move relative to the peripheral surface of the photosensitive drum 1. Therefore, the peripheral movement direction in which magnetic particles are moved between the two nips formed by the photosensitive drum 1 and the two magnetic brushes is as indicated by an arrow mark a, which is opposite to the peripheral movement direction of the photosensitive drum 1. The two charge devices 301 and 302 share the magnetic particles 35 in such a manner that magnetic brushes are formed, one for one, on the peripheral surfaces of the charge sleeves 31 and 32, by the magnets 33 disposed in the hollows of the charge sleeves 31 and 32, one for one. The body of magnetic particles 35 on the peripheral surface of the second charge sleeve 32 is regulated in thickness by a regulation blade 34 as a member for regulating the amount of magnetic particles allowed to remain on the peripheral surface of the charge sleeve 32, so that the proper amount of magnetic particles 35 are held to the peripheral surface of the charge roller 32 for satisfactorily charging the photosensitive drum 1. As voltage is applied to the charge sleeves, with the magnetic brushes kept in contact with the photosensitive drum 1, being kept stationary or being moved with the peripheral surfaces of the charge sleeves, the electric charge is transferred from the magnetic particles to the photosensitive drum 1, that is, the photosensitive drum 1 is charged. Incidentally, instead of employing both of the charge sleeves as magnetic particle bearing members, and magnets, magnetic particles may be directly borne by the magnets; in other words, the charging devices may be structured so that the magnets function as magnetic particle bearing members as well as magnetic field generating members.

The magnets in the first and second charge sleeves each have multiple magnetic poles, and are positioned so that the section of the magnet in the first charge sleeve, where two magnetic poles identical in polarity are located next to each other, opposes the portion of the magnet in the second charge sleeve, where two magnetic poles identical in polarity to each other, but opposite in polarity to the two magnetic poles in the corresponding section of the magnet in the first charge sleeve are positioned.

With the employment of the above-described structural arrangement, the magnetic particles 35 are made to efficiently transfer from one charge sleeve to the other, while moving with the peripheral surfaces of the two charge sleeves 31 and 32, and virtually none of them goes through the gap between the two charge sleeves 31 and 32. The higher the efficiency with which the magnetic particles are made to move with the peripheral surfaces of the charge sleeves 31 and 32, the more uniformly in thickness the magnetic particles are coated on the peripheral surfaces of the 31 and 32, and therefore, the smaller the amount of frictional wear on the drum by the magnetic particles, and the smaller the degree of the nonuniformity with which the drum is frictionally worn.

The average particle diameter, saturation magnetization, and electrical resistance of the magnetic particles for charge injection are desired to be in the ranges of 10–100 μm, 20–250 emu/cm$^3$, and $10^2$–$10^{10}$ Ω·cm, respectively. In consideration of the possibility that a photosensitive drum may have an insulative defect, such as a pinhole, the resistance of the magnetic particles is preferred to be no less than $10^6$ Ω·cm. For the purpose of improving a charging apparatus in charging performance, the electrical resistance of the magnetic particles 35 is desired to be as small as possible. In this embodiment, therefore, such magnetic particles for charge injection that are 20 μm in average particle diameter, 200 emu/cm$^3$ in saturation magnetization, and $5\times10^6$ Ω·cm in electrical resistance are employed. Further, the magnetic particles for charge injection in this embodiment are obtained using a process in which ferrite is oxidized across the surface, and then, is reduced to adjust its electrical resistance.

The above-mentioned value of the electrical resistance of the magnetic particles 35 for charge injection was measured in the following manner: 2 g of the magnetic particles for charge injection were placed in a metallic cell with a bottom area size of 228 mm$^2$, and compacted with the application of a load of 6.6 kg/cm$^2$. Then, the resistance was measured while applying a voltage of 100 V.

In order to test the effects of the present invention, the following experiments were carried out.

(Experiment 1)

The relationship between the amount by the peripheral surface of the photosensitive drum 1 was frictionally worn by the magnetic particles, and the amount of the magnetic particles borne on the peripheral surfaces of the charge sleeves 31 and 32, in the nip between the photosensitive drum 1 and first charge sleeve 31 and the nip between the photosensitive drum 1 and second charge sleeve 32, was examined by changing the amount of the magnetic particles borne on the peripheral surfaces of the first and second charge sleeves 31 and 32, in the aforementioned two nips, by changing the rotational speeds of the first and second charge sleeves 31 and 32. Here, the term "nip" refers to the location where the magnetic particles on the peripheral surface of each charge sleeve make contact with the peripheral surface of the photosensitive drum 1.

Figure 1:
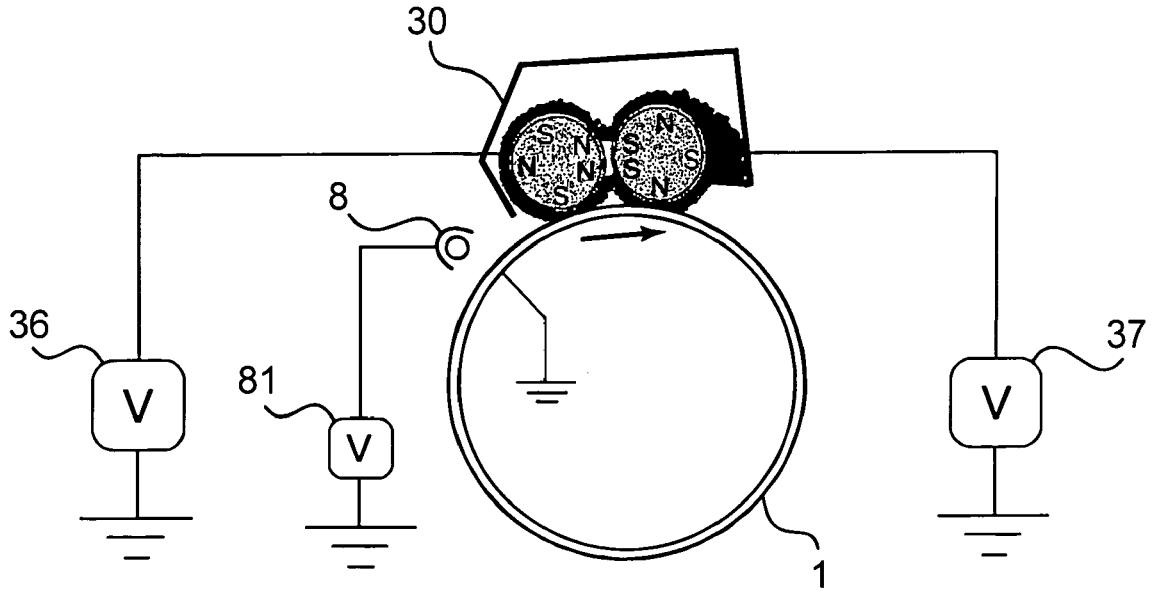
FIG. 1 is a schematic sectional view of the charging apparatus in the first embodiment of the present invention.
Figure 2:
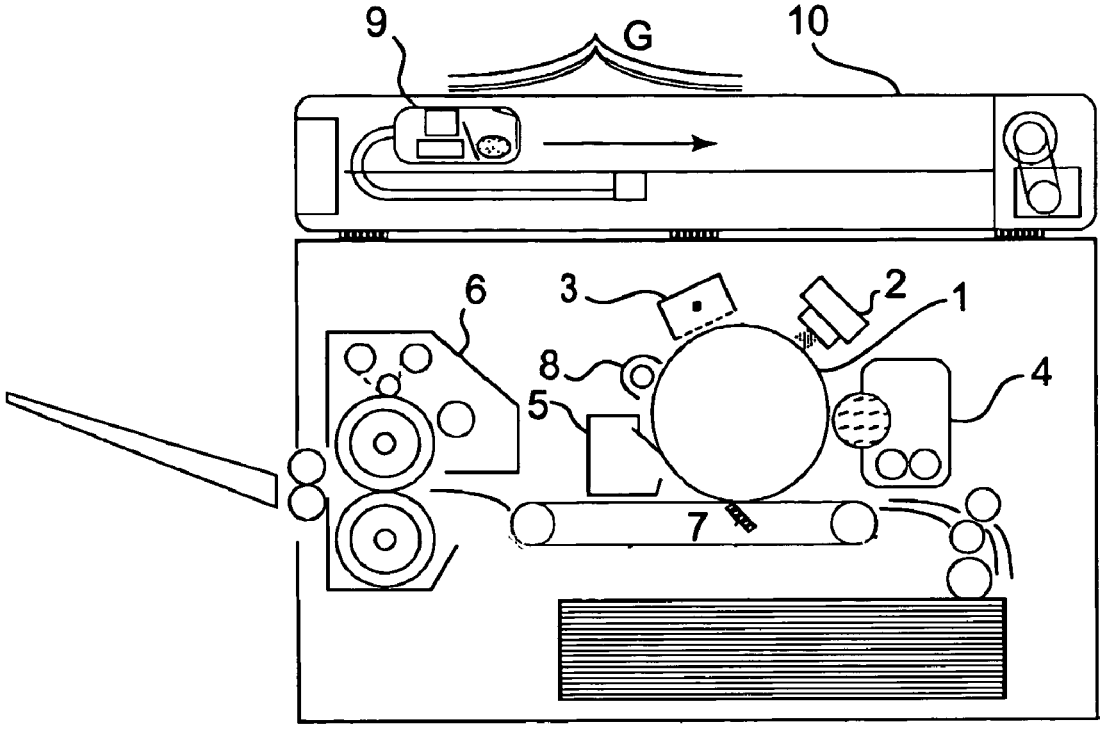
FIG. 2 PRIOR ART
FIG. 2 is a schematic sectional view of a typical image forming apparatus in accordance with the prior art.

In order to measure only the amount by which the photosensitive drum 1 was frictionally worn by the magnetic particles for charge injection, an apparatus, shown in FIG. 1, in which only the magnetic brush based charging apparatus 30 and pre-exposing apparatus 8 were placed around the peripheral surface of the photosensitive drum 1 shown in FIG. 3, was put together.

As the pre-exposure lamp, an LED with a wavelength of 660 nm was employed, and 20 V was applied to the pre-exposure lamp from a pre-exposure lamp power source 81, exposing thereby the photosensitive drum 1 to the pre-exposure light at a rate of roughly 370 Lux/sec.

The photosensitive drum 1 was 80 mm in diameter, and 400 mm/sec in rotational speed. The first and second charge sleeves 31 and 32 are both 16 mm in diameter, and their peripheral surfaces had been blasted with "Arandamu" #180. The gap between the charge sleeve 31 and photosensitive drum 1, and the gap between the charge sleeve 32 and photosensitive drum 1, were set to roughly 400 μm. The gap between the charge sleeve 32 and nonmagnetic regulation blade 34 was set to roughly 200 μm. The charging means container was filled with 100 g of magnetic particles for charge injection. In order to charge the photosensitive drum 1, the combination of +600 V of DC voltage, and AC voltage which is 300 Vpp in peak-to-peak voltage, and 1 kHz in frequency, was applied as charge bias to the first charge sleeve 31 from a charge bias applying apparatus 36, and the combination of +500 V of DC voltage, and AC voltage which is 300 Vpp in peak-to-peak voltage, and 1 kHz in frequency, was applied as charge bias to the second charge sleeve 32 from a charge bias applying apparatus 37.

Under the above-described conditions, the photosensitive drum 1 was rotated the number times equivalent to the formation of 20,000 copies of the A4 size. The amount of the frictional drum wear was obtained as the difference between the thickness of the surface layer of the photosensitive drum 1 measured prior to the 20,000 rotations of the photosensitive drum 1 and that after the 20,000 rotations of the photosensitive drum 1. As for the rotational speeds of the first and second charge sleeves 31 and 32, they were set to 170 and 190 [mm/sec] (Comparative Apparatus 1), 180 and 180 [mm/sec] (Comparative Apparatus 2), 190 and 170 [mm/sec] (Embodiment 1), and 200 and 160 [mm/sec] (Embodiment 2), respectively, and the differences in the amount of frictional drum wear among the four magnetic brush based charging apparatuses were studied.

For the measurement of the thickness of the surface layer of a drum, an interference film thickness gauge was used. The thickness was measured at 56 points, that is, seven positions with 4 cm intervals in terms of the lengthwise direction of the photosensitive drum 1, the center position coinciding with the center of the photosensitive drum 1 in terms of the lengthwise direction, and eight points with 4 cm intervals in terms of the circumferential direction, at each of the seven positions in the lengthwise direction of the photosensitive drum 1.

Figure 5:
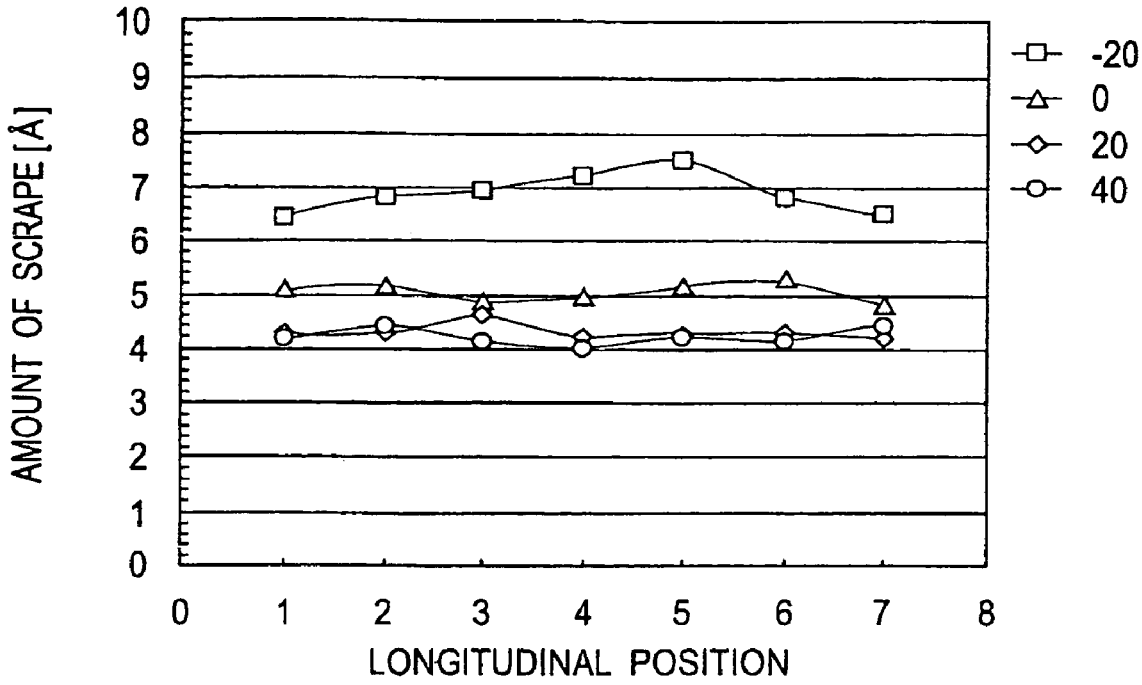
FIG. 5 is the first graph showing the results of the first experiment.
Figure 6:
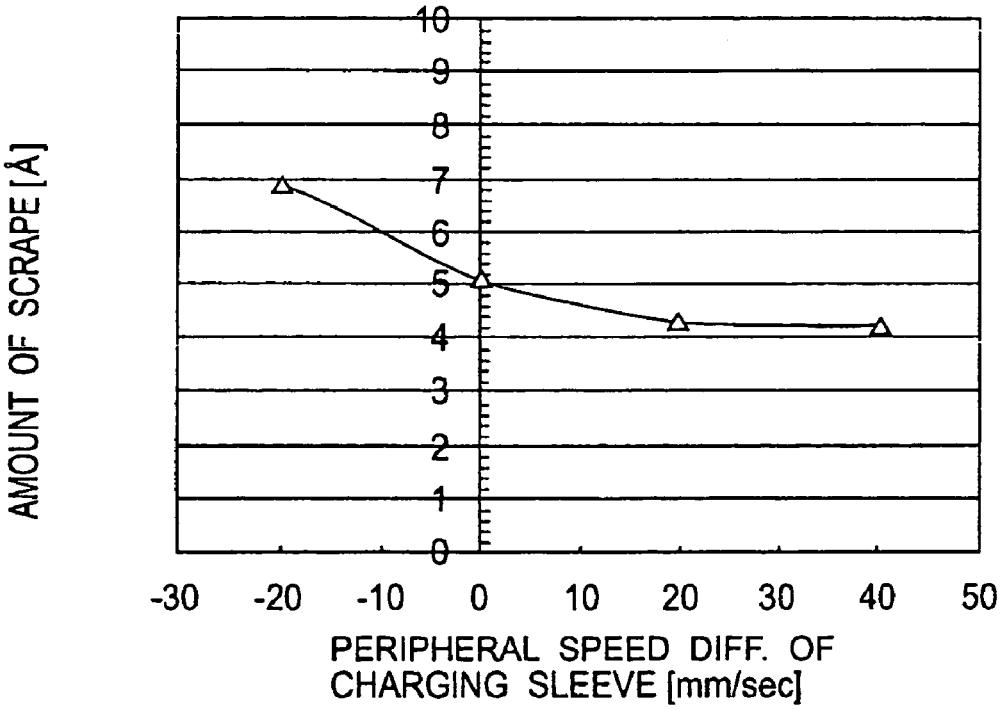
FIG. 6 is the second graph showing the results of the first experiment.

The results of the above-described experiment is given in FIG. 5, in which the abscissa axis represents the positions in terms of the lengthwise direction of the photosensitive drum 1, whereas the ordinate axis represents the average value of the amounts of the frictional drum wear measured at the eight points in terms of the circumferential direction, at each position in terms of the lengthwise direction of the photosensitive drum 1. The legends represent the speeds of the first charge sleeve relative to the speed of the second charge sleeve. In other words, the speeds of the first charge sleeve relative to the speed of the second charge sleeve in the four magnetic brush based charging apparatuses: the speed of a first comparative magnetic brush based charging apparatus, the speed of a second comparative magnetic brush based charging apparatus, the speed of a magnetic brush based charging apparatus in the first embodiment, and the speed of a magnetic brush based charging apparatus in the second embodiment, were "−20", "0", "20", and "40", [mm/sec], respectively. As will be evident from the results, the greater the rotational speed of the first charge sleeve 31 relative to that of the second charge sleeve 32, the smaller the amount of the frictional drum wear, and the less nonuniform the amount of the frictional drum wear in terms of the circumferential direction of the photosensitive drum 1. Plotted, relative to the rotational speed of the first charge sleeve 31 relative to the second charge sleeve 32, in FIG. 6 are the average values of the amounts of the frictional drum wear at the eight points in terms of the circumferential direction of the photosensitive drum 1, at the seven positions in terms of the lengthwise direction of the photosensitive drum 1, in other words, average values of the amounts of the frictional drum wear at all 56 points. As will be evident from FIG. 6, the greater the speed of the first charge sleeve 31 relative to that of the second charge sleeve 32, the smaller the amount of the frictional drum wear.

Figure 9:
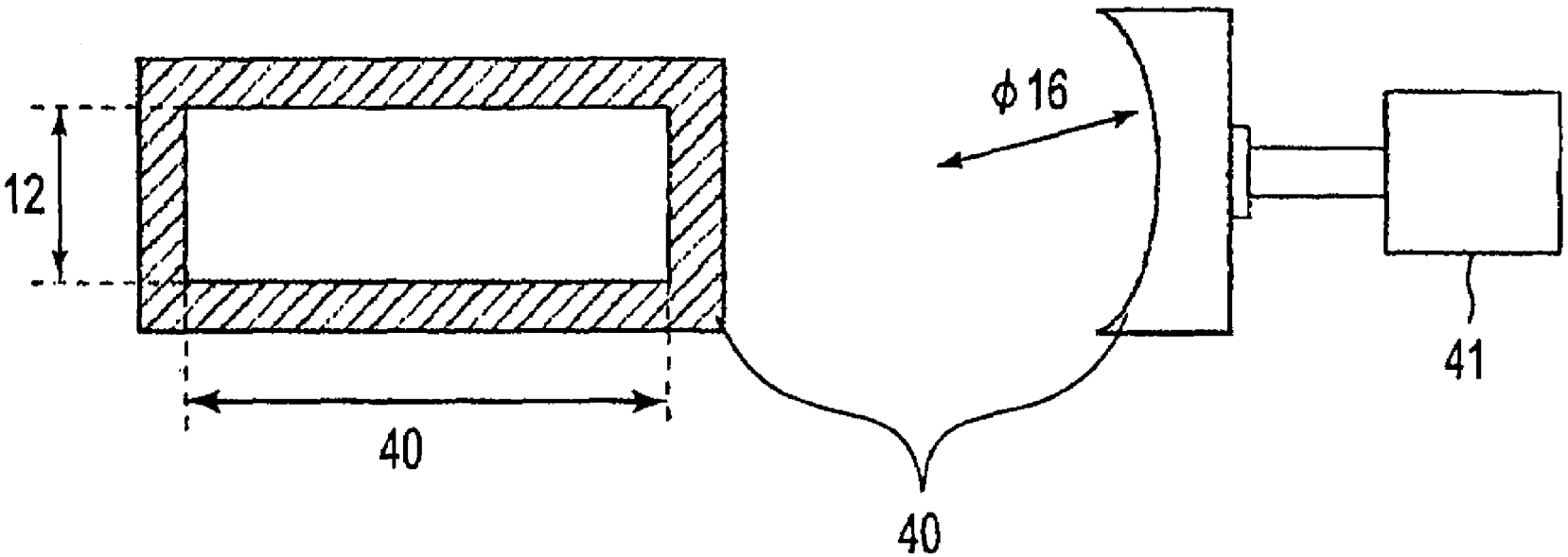
FIG. 9 is a jig for measuring the amount of the magnetic particles on a magnetic particle bearing member.

Next, the amount of the magnetic particles which were on the peripheral surface of each charge sleeve at the nip between the photosensitive drum 1 and charge sleeve was measured with the use of a measuring jig 40, shown in FIG. 9, which comprised a window 40 and a concave member. The window had an opening measuring 40 mm in length and 12 mm in width, and the concave was 16 mm in the curvature. The amount of the magnetic particles on each charge roller was measured at a point which roughly corresponded in position to the primary pole of the magnet in the charge sleeve. As for the method of measurement, the magnetic brush based charging devices were set under the same conditions as those for the preceding experiment. The photosensitive drums, and first and second charge sleeves were rotated for five seconds at a predetermined speed, and stopped. Then, the amount of the magnetic particles on the peripheral surface of the charge sleeves was measured. More specifically, the above-described measuring jig 40 was placed in contact with the peripheral surface of each charge sleeve, and the magnetic particles which were present within the opening of the window were collected by the suction from a suctioning apparatus 41. Then, the amount of the magnetic particles collected by the suction was divided by the area size of the opening of the window of the measuring jig 40, obtaining thereby the average amount of the magnetic particles for charge injection per unit of area. As for the points of measurement, three points were selected; a point corresponding to the center of a charge sleeve in terms of its lengthwise direction, and two points which were 8 cm away from the center point in the opposing directions. In other words, the average value of the amounts of the magnetic particles for charge injection, on each charge sleeve, measured at these three points, were accepted as the amount of the magnetic particles for charge ejection on the charge sleeve.

The amounts of the magnetic particles on the charge sleeves 31 and 32 when the rotational speeds of the charge sleeves 31 and 32 are 170 and 190 [mm/sec] (Comparative Apparatus 1), 180 and 180 [mm/sec] (Comparative Apparatus 2), 190 and 170 [mm/sec] (Embodiment 1), and 200 and 160 [mm/sec] (Embodiment 2), were 58–55, 55–56, 52–56, and 50–56 [mg/cm$^2$], respectively.

The results of the experiment regarding the amount of the magnetic particles on the charge sleeves are summarized in the following table. As for the evaluation of the frictional drum wear, when the amount of the frictional drum wear was no less than 6 A, it was evaluated as "N", which denotes the most severe frictional drum wear in this experiment, and when it was no less than 5 A, but no more than 6 A, it was evaluated as "F", which denotes less severe frictional drum wear in this experiment than the drum wear denoted by "N". When it was no more than 5 A, it was evaluated as "G", which denotes the least frictional drum wear in this experiment.

TABLE 1

| | Comp. Ex. 1 | Comp. Ex. 2 | Ex. 1 | Ex. 2 |
|---|---|---|---|---|
| Rotational speed of first charging sleeve (mm/sec) | 170 | 180 | 190 | 200 |
| Rotational speed of second charging sleeve (mm/sec) | 190 | 180 | 170 | 160 |
| Gap between drum and sleeves | 400 | 400 | 400 | 400 |
| Carrying amount of magnetic particles on first sleeve (mg/cm$^2$) | 58 | 55 | 52 | 50 |
| Carrying amount of magnetic particles on second sleeve (mg/cm$^2$) | 55 | 56 | 56 | 56 |
| Drum wear | N | F | G | G |

When the rotational speed of the first charge sleeve 31 was greater than that of the second charge sleeve 32 as it was in Embodiments 1 and 2, the greater the difference between the first and second charge sleeves 31 and 32, the smaller the amount of magnetic particles borne by the first charge sleeve 31, and therefore, the friction between the magnetic particles the photosensitive drum 1, in the nip between the charge sleeve 31 and photosensitive drum 1, and therefore, the smaller the amount of the frictional drum wear. When the first and second charge sleeves 31 and 32 are rotated at the same rotational speed as in Comparative Apparatus 1, the amounts of magnetic particles borne by the first and second charge sleeves 31 and 32 were virtually the same, and the increase in the rotational speed of the charge sleeve 31 did not reduce the friction between the photosensitive drum 1 and magnetic particles, in the nip between the first charge sleeve 31 and photosensitive drum 1; on the contrary, the amount of the frictional drum wear was greater than those in First and Second Embodiment 1. When the second charge sleeve 32 was greater in rotational speed than the first charge sleeve 31 as it was in Comparative Apparatus 1, the amount of magnetic particles borne by the first charge sleeve 31 was greater than that borne by the second charge sleeve 32.

Therefore, the friction between the magnetic particles for charge injection and photosensitive drum 1 was greater, resulting in an increase in the amount of the frictional drum wear. As can easily be deduced from the above-described results of the above-described experiment, the amount of frictional wear of the drum can be reduced by making the amount of magnetic particles borne by the first charge sleeve 31 smaller than that borne by the second charge sleeve 32. Although the reduction in the amount of magnetic particles borne by the first charge sleeve 31 results in a reduction in the charging performance of the first magnetic brush based charging device, this reduction in the charging performance of the first magnetic brush based charging device can be compensated for by the second magnetic brush based charging device, because it is assured by the regulation blade 34 that the second magnetic brush based charging device is always supplied with the magnetic particles by the amount necessary for compensating for the above-described reduction in the charging performance of the first magnetic brush based charging device. Therefore, it does not occur that the photosensitive drum 1 is insufficiently charged. Further, it is possible that the magnetic particles on the first charge sleeve 31 are transferred therefrom onto the photosensitive drum 1 due to the difference in potential level between the first charge sleeve 31 and photosensitive drum 1, which is present during the charging of the photosensitive drum 1. However, even if a certain amount of the magnetic particles are transferred from the first charge sleeve 31 onto the photosensitive drum 1, they will be magnetically and dynamically captured by the second charge sleeve 32. Therefore, this transfer of a small amount of the magnetic particles from the first charge sleeve 31 onto the photosensitive drum 1, which might occur during the charging of the photosensitive drum 1, does not create a problem.

In the above-described experiment, the amount by which the photosensitive drum 1 was frictionally worn by the magnetic particles was reduced by making the first charge sleeve 31 greater in rotational speed than the second charge sleeve 32. However, making the first charge sleeve 31 unnecessarily greater in rotational speed than the second charge sleeve 32 excessively reduces the amount of magnetic particles borne by the second charge sleeve 32, reducing thereby the second magnetic brush based charging device in charging performance. Therefore, the rotational speeds V1 and V2 of the first and second charge sleeves 31 and 32, respectively, are desired to be set so that V1 will be no more than twice V2.

(Experiment 2)

Next, the second experiment will be described. In this experiment, the gap between the first charge sleeve 31 and photosensitive drum 1, and the gap between the second charge sleeve 32 and photosensitive drum 1, were reduced to 250 μm. Otherwise, this experiment was the same as the first experiment. In other words, the amounts of the magnetic particles borne on the first and second charge sleeves 31 and 32 were measured under the same conditions as those in the first experiment, except for the gaps between the first charge sleeve 31 and photosensitive drum 1, and between the second charge sleeve 32 and photosensitive drum 1.

More specifically, also in this experiment, the photosensitive drum 1 was rotated the number of times equivalent to the formation of 20,000 copies of the A4 size. The amount of the frictional drum wear was obtained as the difference between the thickness of the surface layer of the photosensitive drum 1 measured prior to the 20,000 rotations of the photosensitive drum 1 and that after the 20,000 rotations of the photosensitive drum 1. As for the rotational speeds of the first and second charge sleeves 31 and 32, there were four combinations, which were 170 and 190 [mm/sec] (Comparative Apparatus 3), 180 and 180 [mm/sec] (Comparative Apparatus 4), 190 and 170 [mm/sec] (Embodiment 3), and 200 and 160 [mm/sec] (Embodiment 4), respectively, and the difference in the amount of frictional drum wear among the four combinations between the rotational speeds of the first and second charge sleeves 31 and 32 were studied.

Figure 7:
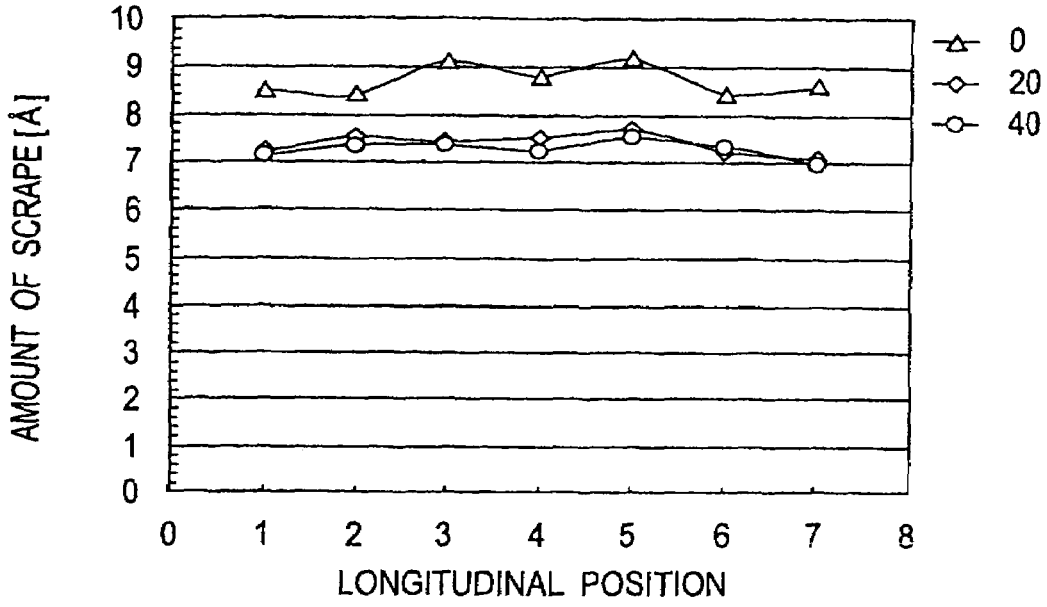
FIG. 7 is the first graph showing the results of the second experiment.

The results of the above described experiment are given in FIG. 7, in which the abscissa axis represents the positions in terms of the lengthwise direction of the photosensitive drum 1, whereas the ordinate axis represents the average value of the amounts of the frictional drum wear measured at the eight points in terms of the circumferential direction, at each position in terms of the lengthwise direction of the photosensitive drum 1. In this experiment, when the combination of the rotational speeds of the first and second charge sleeves 31 and 32 were 170 mm/sec and 190/sec, respectively, (Comparative Apparatus 3), the nips became satiated with the magnetic particles 35, making it impossible to continue the image formation. It is evident from FIG. 7 that the greater the rotational speed of the first charge sleeve 31 relative to the second charge sleeve 32, the smaller the amount of the frictional drum wear, and the smaller the nonuniformity in the frictional drum wear in terms of the lengthwise direction of the photosensitive drum 1. Plotted, relative to the difference in rotational speed between the first charge sleeve 31 and the second charge sleeve 32, in FIG. 6 are the average values of the amounts of the frictional drum wear at the eight points in terms of the circumferential direction of the photosensitive drum 1, at the seven positions in terms of the lengthwise direction of the photosensitive drum 1, in other words, average values of the amounts of the frictional drum wear at all 56 points. As will be evident from FIG. 8, in this experiment in which the gaps between the first charge sleeve 31 and photosensitive drum 1, and between the second charge sleeve 32 and photosensitive drum 1, were smaller than those in the first experiment, the frictional drum wear was greater than that in the first experiment.

Figure 8:
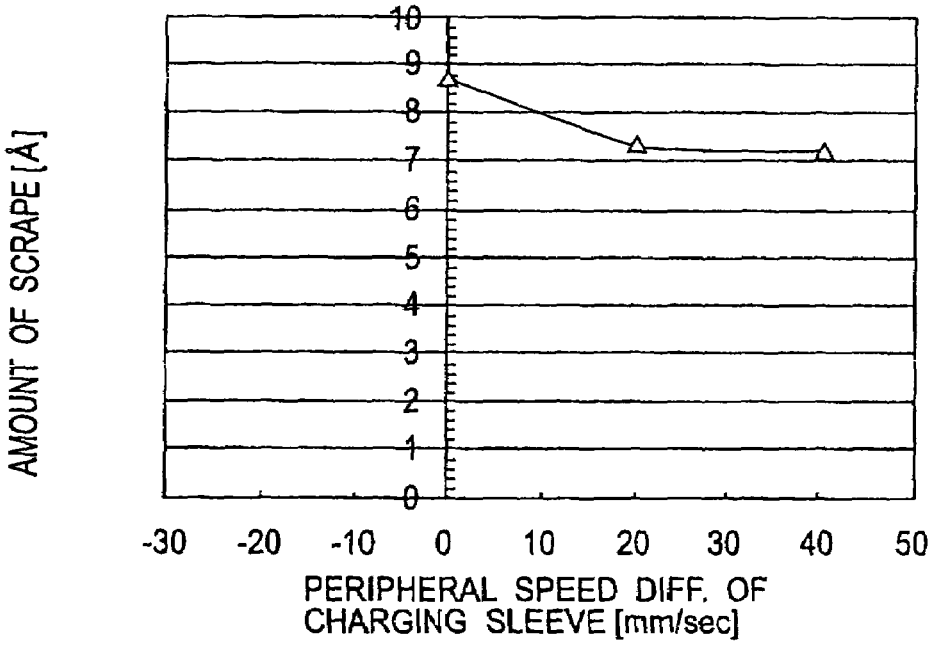
FIG. 8 is the second graph showing the results of the second experiment.

Also evident from FIG. 8 is that the greater the rotational speed of the first charge sleeve 31 relative to the second charge sleeve 32, the smaller the amount of the frictional drum wear. In other words, the same tendency as that in the first experiment was observed also in this experiment.

Given in the following table are the relationship among the conditions under which the amount by which each of the photosensitive drums in the embodiments and comparative apparatuses was frictionally worn, actual amounts of the frictional drum wear, and amount (inclusive of satiation) of the magnetic particles on the charge sleeves. When the amount of the frictional drum wear was no less than 8 Å, it was evaluated as "F", and when it was no more than 8 Å, it was evaluated as "G". As for the evaluation of the satiation of the nips with the magnetic particles, when the nips were satiated with the magnetic particles, it was evaluated as "N", and when the nips were not satiated with the magnetic particles, it was evaluated as "G".

TABLE 2

| | Comp. Ex. 3 | Comp. Ex. 4 | Ex. 3 | Ex. 4 |
|---|---|---|---|---|
| Rotational speed of first charging sleeve (mm/sec) | 170 | 180 | 190 | 200 |

TABLE 2-continued

| | Comp. Ex. 3 | Comp. Ex. 4 | Ex. 3 | Ex. 4 |
|---|---|---|---|---|
| Rotational speed of second charging sleeve (mm/sec) | 190 | 180 | 170 | 160 |
| Gap between drum and sleeves | 250 | 250 | 250 | 250 |
| Drum wear | — | F | G | G |
| Satiation of particles | N | G | G | G |

If the gap between a charge sleeve and photosensitive drum is as small as the gap in this experiment, there is the possibility of the occurrence of the problem that when the rotational speed of the first charge sleeve is less than the rotational speed of the second charge sleeve, the space surrounded by the peripheral surfaces of the first and second charge sleeves, and peripheral surface of the photosensitive drum, are satiated with the magnetic particles. However, this problem, or the satiation of the aforementioned space with the magnetic particles, can be prevented by setting the rotational speeds of the first and second charge sleeves so that the first charge sleeve will be greater in rotational speed than the second charge sleeve.

The mechanism of the above-described phenomena may be deduced from the results of the above-described two experiments in which the first and second embodiments of the present invention were tested, and the mechanism of the occurrences of the above-described phenomena may be summarized as follows.

The amount by which a photosensitive drum is frictionally worn by the first and second charge sleeves 31 and 32 is smaller when the rotational speed of the first charge sleeve 31 is greater than that of the second charge sleeve 32 than when the rotational speed of the first charge sleeve 31 is less than that of the second charge sleeve 32, because, the amount of magnetic particles for charge injection coated on the second charge sleeve 32 is determined almost exclusively by the size of the gap between the regulation blade 34 and second charge sleeve 32; it has virtually no relation to the rotational speed thereof. In comparison, the amount of magnetic particles borne on the first charge sleeve 31 is dependent upon the difference in rotational speed between the first and second charge sleeves 31 and 32; as the difference changes, the amount of magnetic particles borne by the charge sleeve 31 also changes. Further, as is evident from the results of the experiments, the greater the rotational speed of the first charge sleeve 31 relative to that of the second charge sleeve 32, the smaller the amount of magnetic particles borne by the first charge sleeve 31, and therefore, the smaller the amount of the frictional drum wear. On the contrary, when the rotational speed of the second charge sleeve 32 is greater than that of the first charge sleeve 31, the amount of magnetic particles borne by the first charge sleeve 31 is greater than that borne by the second charge sleeve 32, and therefore, the greater the friction between the photosensitive drum 1 and magnetic particles. Further, when the gap between the first charge sleeve 31 and photosensitive drum 1 is as small as that in the third comparative apparatus, the amount of magnetic particles delivered to the first charge sleeve 31 from the second charge sleeve 32 exceeds the maximum rate at which the magnetic particles are allowed to go through the gap between the first charge sleeve 31 and photosensitive drum 1, causing the magnetic particles for charge injection to gradually accumulate on the upstream side of the nip between the first charge sleeve 31 and photosensitive drum 1. As a result, the problem that the upstream side of the nip is satiated with the magnetic particles occurs.

Figure 10:
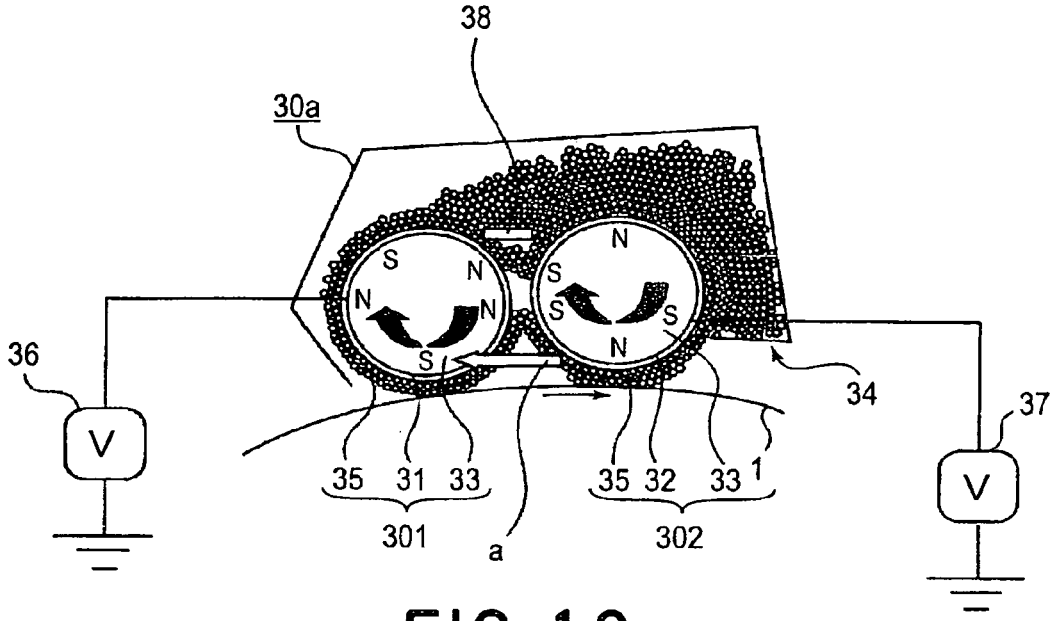
FIG. 10 is one of the modification of the charging apparatus in the first embodiment.

As for the means for preventing the amount of magnetic particles 35 coated on the first charge sleeve 31, from increasing, it is expedient to reduce the amount of magnetic particles 35 for charge injection going through the gap between the two charge sleeves 31 and 32, so that the magnetic particles smoothly move with the peripheral surfaces of the two charge sleeps 31 and 32, and smoothly transfer from one charge sleeve to the other. In this embodiment, the two magnets in the charge sleeves 31 and 32, one for one, are positioned so that the two magnets are opposite in polarity in the area where the two charge sleeves 31 and 32 oppose each other. However, the following structural arrangement, which is a modification of the structural arrangement in this embodiment is feasible. That is, the magnetic brush based charging apparatus 31 shown in FIG. 1 may be modified into the magnetic brush based charging apparatus 30*a* shown in FIG. 10, which is roughly the same in structure as the magnetic brush based charging apparatus 30 shown in FIG. 4. The only difference in structure between the charging apparatus 30*a* and the charging apparatus 30 in FIG. 4 is that the charging apparatus 30*a* is provided with a regulating member 38, which is disposed a predetermined distance above the area in which the peripheral surfaces of the first and second charge sleeves 31 and 32 oppose each other, in order to regulate the amount of magnetic particles for charge injection on the first charge sleeve 31 that are allowed to move into the area in which the peripheral surfaces of the first and second charge sleeves 31 and 32 oppose each other.

The addition of the regulating member 38 proved to be effective to reduce the amount of magnetic particles 35 for charge injection going through the gap between the two charge sleeves 31 and 32, being therefore effective to prevent the amount of magnetic particles for charge injection coated on the first charge sleeve 31, from increasing, and also, to reduce the nonuniformity in thickness with which the magnetic particles for charge injection are coated on the first charging sleeve 31. In other words, the addition of the regulating member 38 can prevent the amount of magnetic particles for charge injection coated on the first charge sleeve 31, from increasing, making it thereby possible to uniformly coating the first charge sleeve 31 with the magnetic particles for charge injection. Therefore, it can improve a magnetic brush based charging apparatus in terms of the amount and nonuniformity of the frictional drum wear.

Further, reducing the gap between the peripheral surface of the first charge sleeve 31 and the regulating member 38 to a value no more than the volume average particle diameter of the magnetic particle for charge injection enhances the effectiveness with which the regulating member 38 regulates the magnetic particles for charge injection.

Figure 11:
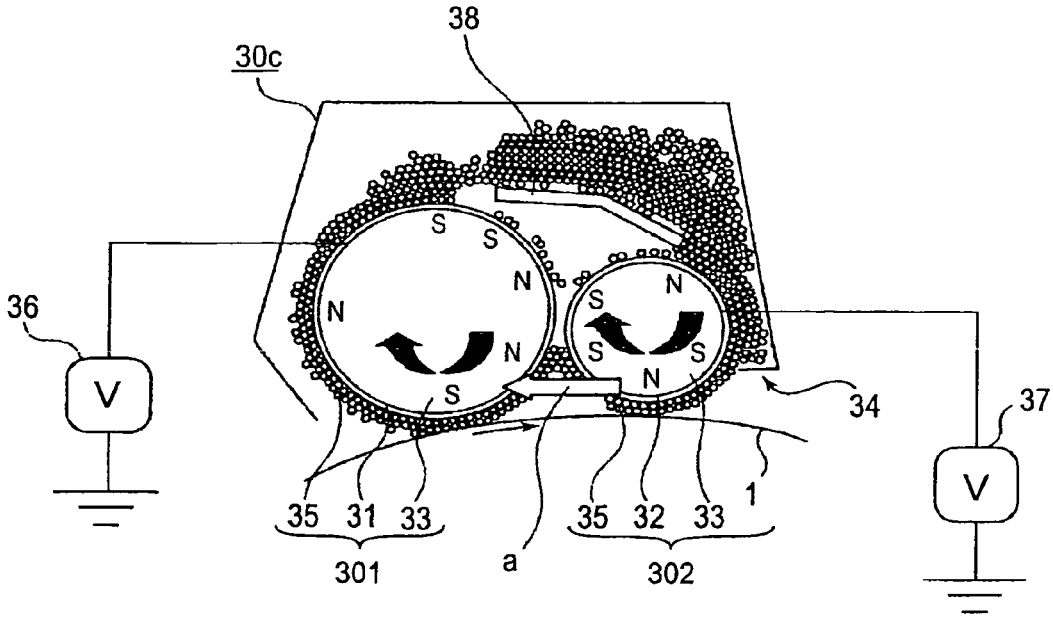
FIG. 11 is another modification of the charging apparatus in the first embodiment.

As another modification of this embodiment, the magnetic brush based charging apparatus 30 shown in FIG. 1 may be modified into the magnetic brush based charging apparatus 30*c* shown in FIG. 11. More specifically, the magnetic brush based charging apparatus 30*c* in FIG. 11 is provided with a first charge sleeve 33, instead of the first charge sleeve 31. The magnetic poles of the magnet in the first charge sleeve 33 are arranged so that two adjacent sections thereof, in terms of the circumferential direction of the first charge sleeve 33, are provided with two magnetical poles identical in polarity. Further, the magnets in the first and second charge sleeve 33 and 32 are positioned so that in order to enhance the efficiency with which the magnetic particles are transferred from one charge sleeve to the other, one of the two sections of the magnet in the first charge sleeve 33, having two magnetic poles identical in polarity, opposes the section of the magnet in the second charge sleeve 32, having two magnetic poles identical in polarity to each other, but opposite in polarity to the two magnetic poles of the section of the first charge sleeve 33, to which they oppose, and also, so that in order to enhance the effectiveness of the regulating member 38 for regulating the magnetic particles for charge injection, the other section of the magnet in the first charge sleeve 33, having the two magnet poles identical in polarity, is positioned in the adjacencies of the upstream end of the regulating member 38 in terms of the moving direction of the magnetic particles.

In the case of the magnetic brush based charging apparatus shown in FIG. 11, the regulating member 38 is shaped, sized, and positioned so that the half of the regulating member 38, on the second charge sleeve 32 side, tilts toward the second charge sleeve 32, and the edge of the other half reaches a predetermined point, which is in the adjacencies of the peripheral surface of the first charge sleeve 31, and which corresponds in position to the upstream section of the aforementioned two sections of the magnet, in the first charge sleeve 31, having the two magnetic poles identical in polarity. Shaping, sizing, and positioning the regulating member 38, as described above, so that the magnetic particles for charge injection are guided by the regulating member 33 from the first charge sleeve 31 onto the second charge sleeve 32 makes it possible to more smoothly move the magnetic particles for charge injection so that the magnetic particles are efficiently transferred from one charge sleeve to the other, and also, so that the magnetic particles are not allowed to go through the gap between the two charge sleeves.

With the employment of the above-described structural arrangement, the problem that the magnetic particles for charge injection go through the gap between the two charge sleeves can be prevented to stabilize the amount of magnetic particles for charge injection coated on the peripheral surface of the first charge sleeve 31.

One of the essential points of the present invention is to make the amount of magnetic particles for charge injection borne by the magnetic particle bearing member, on the downstream side in terms of the direction in which the magnetic particles are conveyed in the nips between the magnetic particle bearing members and photosensitive drum 1, smaller than the amount of magnetic particles for charge injection borne by the magnetic particle bearing member on the upstream side. There are other methods for making the amount of magnetic particles borne by the first charge sleeve smaller than the amount of charge particles borne by the second charge sleeve. For example, it is possible to make the peripheral surface of the first charge sleeve greater in surface roughness (ten point average surface roughness Ra: JIS) than the second charge sleeve to make the first charge sleeve superior in particle conveyance efficiency to the second charge sleeve while keeping the first and second charge sleeves equal in peripheral velocity, in order to make the amount of magnetic particles borne by the first charge sleeve, smaller than the amount of charge particles borne by the second charge sleeve. It is also possible to modify the magnets in the charge sleeves, in the positioning of the magnetic poles, the amount of magnetic force, etc., to achieve the object of the present invention. In other words, the means for realizing the effects of the present invention are not limited to that in the above-described embodiments.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus comprising:

a first magnetic particle carrying member configured and positioned to carry magnetic particles; and a second magnetic particle carrying member configured and positioned to carry the magnetic particles, said second magnetic particle carrying member being disposed upstream of said first magnetic particle carrying member with respect to a feeding direction of the magnetic particles at a nip formed between said first magnetic particle carrying member and a member to be charged, wherein the magnetic particles are commonly used by said first magnetic particle carrying member and said second magnetic particle carrying member, wherein the member to be charged is electrically charged by being contacted by a magnetic brush comprising the magnetic particles, wherein said first magnetic particle carrying member and said second magnetic particle carrying member move in the same peripheral direction relative to the member to be charged such that the peripheral movement directions of the first magnetic particle carrying member and the second magnetic particle carrying member are opposite to a peripheral movement direction of the member to be charged at a portion where they are opposed to the member to be charged, and wherein the amount of the magnetic particles carried on said second magnetic particle carrying member at a nip formed between said second magnetic particle carrying member and the member to be charged is larger than the amount of magnetic particles carried on said first magnetic particle carrying member at the nip formed between said first magnetic particle carrying member and the member to be charged.

2. An apparatus according to claim 1, further comprising a magnetic particle carrying amount regulating member configured and positioned to regulate the amount of the magnetic particles carried on said second magnetic particle carrying member, said magnetic particle carrying amount regulating member being disposed upstream of the nip formed between said second magnetic particle carrying member and the member to be charged, with respect to the magnetic particle feeding direction.

3. An apparatus according to claim 1, further comprising a regulating member configured and positioned to regulate the amount of the magnetic particles carried on a surface of said first magnetic particle carrying member which are fed to a portion where said second magnetic particle carrying member and said first magnetic particle carrying member are opposed to each other.

4. An apparatus according to claim 3, wherein said regulating member has a function of guiding the magnetic particles from said first magnetic particle carrying member to said second magnetic particle carrying member.

5. An apparatus according to claim 3, wherein said first magnetic particle carrying member includes a magnetic field generating member having a plurality of magnetic poles therein, wherein an end portion of said regulating member is disposed in the neighborhood of a region where two of said magnetic poles of the same polarity are adjacent to each other.

6. An apparatus according to claim 3, wherein a gap is provided between said regulating member and said first magnetic particle carrying member.

7. An apparatus according to claim 6, wherein the gap is smaller than a volume average particle size of the magnetic particles.

8. An apparatus according to claim 1, wherein said first magnetic particle carrying member and said second magnetic particle carrying member include respective magnetic field generating members each having a plurality of magnetic poles therein, wherein two of said magnetic poles of the same polarity are adjacent to each other, in each of said first magnetic particle carrying member and said second magnetic particle carrying member.

9. An apparatus according to claim 8, wherein said first magnetic particle carrying member and said second magnetic particle carrying member are opposed to each other in a region where said two magnetic poles in said first magnetic particle carrying member are opposed to each other and two magnetic particles in said second magnetic particle carrying member are opposed to each other.

10. An apparatus according to claim 1, 2 or 3, wherein a rotational speed V1 of said first magnetic particle carrying member and a rotational speed V2 of said second magnetic particle carrying member satisfy V1>V2.

11. An apparatus according to claim 10, wherein the speed VI is not more than 2 times the speed V2.

12. An apparatus according to claim 1, 2 or 3, wherein a surface roughness of said first magnetic particle carrying member is larger than that of said second magnetic particle carrying member.

13. An apparatus according to claim 1, wherein the member to be charged is an amorphous silicon photosensitive member.

14. An apparatus according to claim 1, wherein said charging apparatus effects the electrical charging by directly injecting charge into the member to be charged by contacting the magnetic particles to the member to be charged.

15. An apparatus according to claim 1, wherein the member to be charged is an image bearing member which is provided in a process cartridge detachably mountable to a main assembly of an image forming apparatus together with said charging apparatus.

16. An image forming apparatus comprising:

a member to be charged, which is a photosensitive member;

a charging device configured and positioned to electrically charge said member to be charged by contacting a magnetic brush comprising magnetic particles to said member to be charged;

said charging device including:

a first magnetic particle carrying member;

a second magnetic particle carrying member disposed upstream of said first magnetic particle carrying member with respect to a feeding direction of the magnetic particle particles at a nip formed between said first magnetic particle carrying member and said member to be charged, wherein the magnetic particles are commonly used by said first magnetic particle carrying member and said second magnetic particle carrying member, wherein said first magnetic particle carrying member and said second magnetic particle carrying member move in the same rotational direction relative to the member to be charged such that the first magnetic member and the second magnetic member, respectively move in opposite directions at a portion where they are opposed to said member to be charged, wherein the amount of the magnetic particles carried on said second magnetic particle carrying member at a nip formed between said second magnetic particle carrying member and said member to be charged is larger than the amount of magnetic particles carried on said first magnetic particle carrying member at the nip formed between said first magnetic particle carrying member and said member to be charged;

image exposure means for exposing said member to be charged to light to form an electrostatic latent image thereon;

developing means for forming a toner image by developing the latent image; and transferring means for transferring the toner image onto a transfer material.

* * * * *

UNITED STATES PATENT AND TRADEMARK OFFICE

CERTIFICATE OF CORRECTION

PATENT NO. : 7,130,565 B2
APPLICATION NO. : 10/859344
DATED : October 31, 2006
INVENTOR(S) : Ryo Nakamura et al.

It is certified that error appears in the above-identified patent and that said Letters Patent is hereby corrected as shown below:

COLUMN 2:
Line 7, “an” should read --a--.

COLUMN 6:
Line 42, “bush” should read --brush--.

COLUMN 10:
Line 20, “6A,” should read --6Å,--.
Line 22, “5A,” should read --5Å,--; and “6A,” should read --6Å,--.
Line 25, “5A,” should read --5Å,--.

COLUMN 14:
Line 10, “sleeps” should read --sleeves--.
Line 45, “coating” should read --coat--.

COLUMN 17:
Line 30, “VI” should read --V1--.

COLUMN 18:
Line 14, “particle” should be deleted.

Signed and Sealed this

Twenty-fifth Day of September, 2007

JON W. DUDAS
*Director of the United States Patent and Trademark Office*